US008845346B2

(12) United States Patent
Chan et al.

(10) Patent No.: US 8,845,346 B2
(45) Date of Patent: Sep. 30, 2014

(54) CURRENT CONVERTOR

(71) Applicant: Lien Chang Electronic Enterprise Co., Ltd., New Taipei (TW)

(72) Inventors: Chun-Kong Chan, New Taipei (TW); Ming-Hsiang Chen, New Taipei (TW)

(73) Assignee: Lien Chang Electronic Enterprise Co., Ltd., New Taipei (TW)

( * ) Notice: Subject to any disclaimer, the term of this patent is extended or adjusted under 35 U.S.C. 154(b) by 63 days.

(21) Appl. No.: 13/677,272

(22) Filed: Nov. 14, 2012

(65) Prior Publication Data

US 2014/0134857 A1 May 15, 2014

(51) Int. Cl.
*H01R 13/44* (2006.01)
*H01R 13/447* (2006.01)

(52) U.S. Cl.
CPC ..... *H01R 13/447* (2013.01)
USPC ..... 439/140

(58) Field of Classification Search
USPC ..... 439/140, 141, 149
See application file for complete search history.

(56) References Cited

U.S. PATENT DOCUMENTS

| | | | | | |
|---|---|---|---|---|---|
| 4,445,739 | A * | 5/1984 | Wooten | ..... | 439/140 |
| 5,252,082 | A * | 10/1993 | Hsieh et al. | ..... | 439/141 |
| 6,139,338 | A * | 10/2000 | Hirai et al. | ..... | 439/141 |
| 2003/0077930 | A1 * | 4/2003 | Chu et al. | ..... | 439/140 |

* cited by examiner

*Primary Examiner* — Gary Paumen
(74) *Attorney, Agent, or Firm* — Li & Cai Intellectual Property (USA) Office

(57) ABSTRACT

The current convertor comprises a current converting device and a sliding cover. The current converting device comprises a casing, a current converting module arranged inside the casing, two conductive terminals electrically connected to the current converting module, and a first sliding module disposed on the casing. The conductive terminals are partially exposed from the casing. The sliding cover has a second sliding module having two thru holes. The second sliding module is slidably disposed on the first sliding module for enabling the sliding cover to slide between a first position and a second position relative to the casing. When at the first position, the conductive terminals pass through the thru holes of the sliding cover for inserting into the conventional outlet, and when at the second position, the conductive terminals are arranged in a space surrounded by the sliding cover and the casing.

9 Claims, 8 Drawing Sheets

CURRENT CONVERTOR

BACKGROUND OF THE INVENTION

1. Field of the Invention

The instant disclosure relates to a current convertor; more particular, to a current convertor having a sliding cover to protect the conductive terminals thereof.

2. Description of Related Art

Please refer to FIG. 1, which shows a conventional current convertor 100*a*. The conventional current convertor 100*a* has a casing 1*a*, a rotatable plug 2*a*, and a circuit board 3*a* having a rectangular shape. The casing 1*a* has a notch 101*a* concavely formed from the edge thereof, and the casing 1*a* surroundingly defines an accommodating space 102*a*. The rotatable plug 2*a* is rotatably disposed on the casing 1*a* and can be received in the notch 101*a*. The circuit board 3*a* is arranged in the accommodating space 102*a* of the casing 1*a*.

However, because the casing 1*a* needs to have the notch 101*a* for receiving the rotatable plug 2*a*, so that a lot of space of the accommodating space 102*a*, which is arranged on two opposite sides of the notch 101, cannot be applied. In other words, the current convertor 100*a* cannot be designed smaller because having the rotatable plug 2*a*.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a current convertor having a casing, and the space surrounded by the casing can be effectively used by disposing a sliding cover on the casing.

The current convertor for inserting into a conventional outlet comprises a current converting device and a sliding cover. The current converting device comprises a casing, a current converting module, two conductive terminals, and a first sliding module. The casing surroundingly defines an accommodating space. The current converting module is arranged in the accommodating space of the casing. The conductive terminals are electrically connected to the current converting module and partially exposed from the casing, wherein a direction parallel to the longitudinal direction of each conductive terminal is defined as a sliding direction. The first sliding module is disposed on the casing. The sliding cover has a second sliding module, wherein the second sliding module is slidably arranged with the first sliding module for enabling the sliding cover to slide between a first position and a second position along the sliding direction relative to the casing. The sliding cover has two thru holes, when the sliding cover is at the first position, the sliding cover covers at least partial an outer surface of the casing, and the conductive terminals pass through the thru holes of the sliding cover for inserting into the conventional outlet, and when the sliding cover is at the second position, the conductive terminals are arranged in a space surrounded by the sliding cover and the casing.

Preferably, the first sliding module has a first and a second protrusions respectively protruded from the outer surface of the casing, and the first protrusion is closer to the thru holes of the casing than the second protrusion, wherein the second sliding module has a first and a second track troughs sequentially extended along the sliding direction, and wherein when the sliding cover sliding between the first and the second positions, the first protrusion is arranged in and relatively slidable with respect to the first track trough, and the second track protrusion is arranged in and relatively slidable with respect to the second trough.

Preferably, the second sliding module has a positioning trough formed between the first and the second track troughs, wherein when the sliding cover is at the first position, the second protrusion is wedged with the positioning trough for maintaining the sliding cover at the first position, and wherein when the sliding cover is at the second position, the first protrusion is wedged with the positioning trough for maintaining the sliding cover at the second position.

Preferably, a distance between the first protrusion and the second protrusion is approximately equal to a distance between the first position and the second position.

Preferably, the first sliding module has a bump protruded from the outer surface of the casing, and wherein the second sliding module has a sliding trough extended along the sliding direction, and the bump is arranged in and relatively slidable with respect to the sliding trough.

Preferably, the first sliding module has a first and a second protrusions respectively protruded from two opposite outer surfaces of the casing, the sliding cover has a base seat having the thru holes and two side plates respectively extended from two opposite ends of the base seat along the sliding direction, the second sliding module has a first and a second track holes respectively formed on the side plates along the sliding direction, and wherein the first second protrusion and the second protrusion are respectively arranged in and relatively slidable with respect to the first track hole and the second track hole.

Preferably, each one of the first protrusion and the second protrusion has a hollow shape, the first sliding module has a positioning piece and a buckling ring, and wherein the positioning piece passes through the first protrusion, the casing, and the second protrusion, and the buckling ring is engaged with one portion of the positioning piece passing through the second protrusion.

Preferably, the positioning piece has a head portion, an extending portion, and a wedged portion, and the extending portion connects to the head portion and the wedged portion, and wherein the head portion abuts on one portion of an outer surface of one of the side plates adjacent to the first track hole, the extending portion passes through the first protrusion, the casing, and the second protrusion, and the wedged portion is engaged with the buckling ring and abuts on one portion of an outer surface of another side plate adjacent to the second track hole.

Preferably, when the sliding cover is at the first position, the sliding cover covers fourth to half of the outer surface of the casing.

Preferably, the distance of one portion of each conductive terminal exposed from the casing is approximately equal to a distance between the first position and the second position.

Base on the above, the space surrounded by the casing of the current convertor in the instant disclosure is applied effectively by setting the sliding cover without any wasted space.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

First Embodiment

Figure 1:
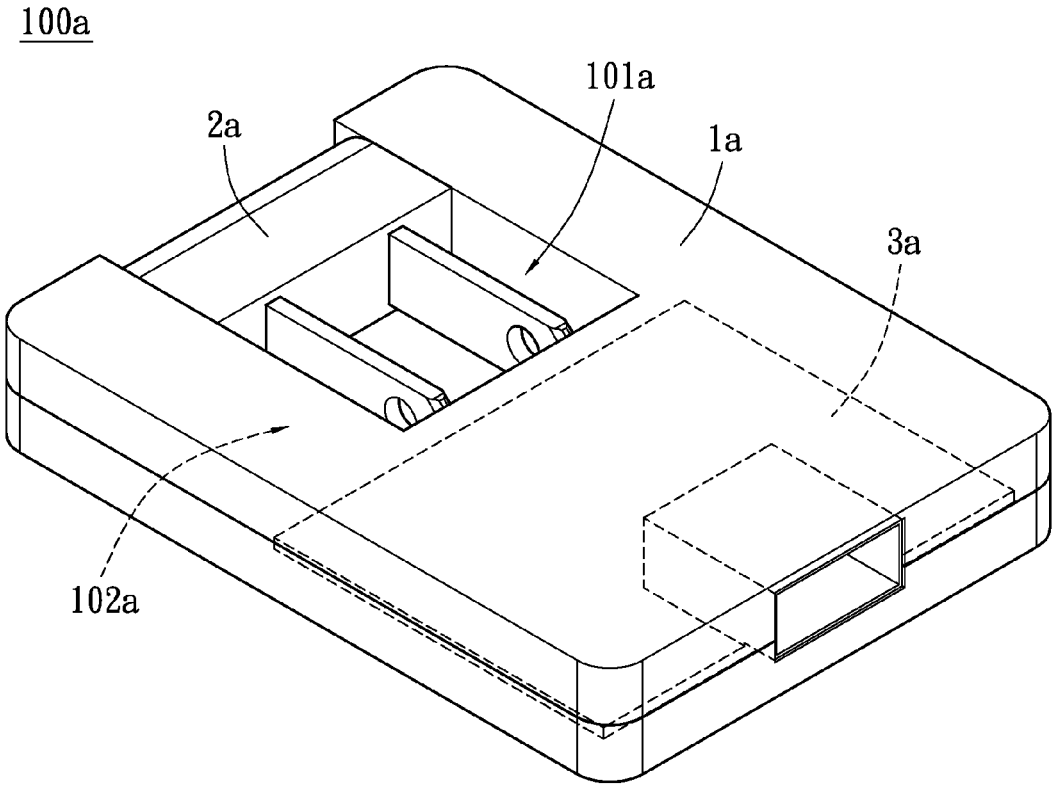
FIG. 1 PRIOR ART
FIG. 1 is a perspective view of a conventional current convertor.
Figure 2A:
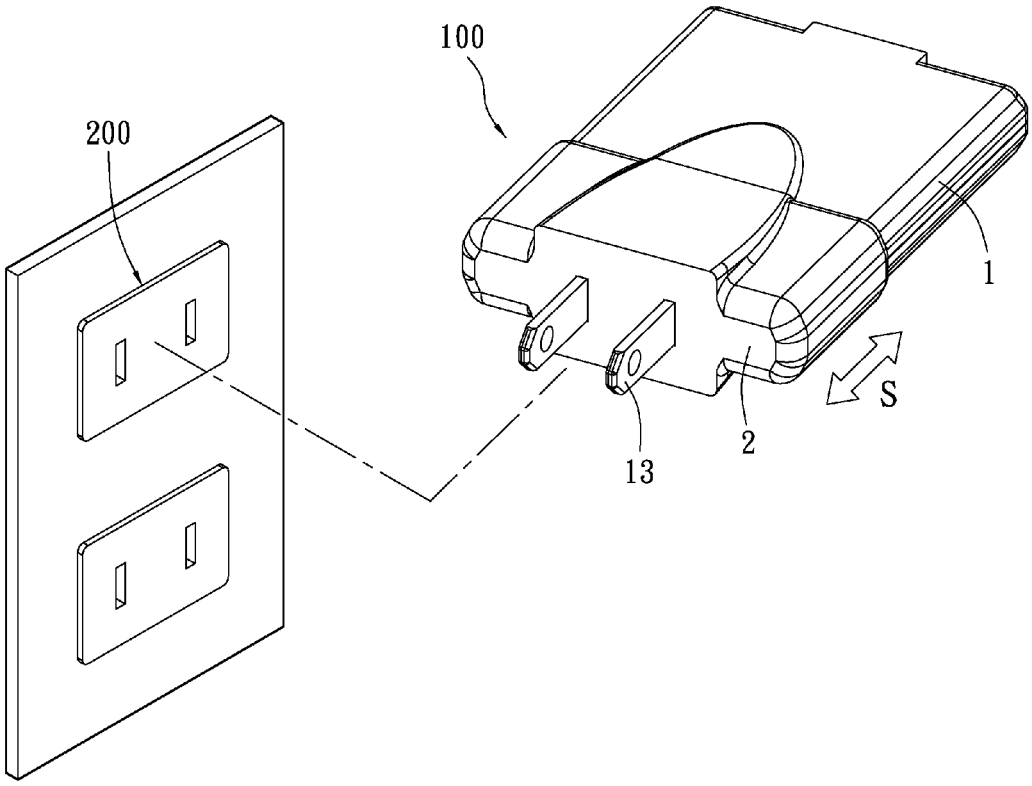
FIG. 2A is a perspective view of a current convertor of a first embodiment of the instant disclosure when a sliding cover is at a first position.
Figure 5A:
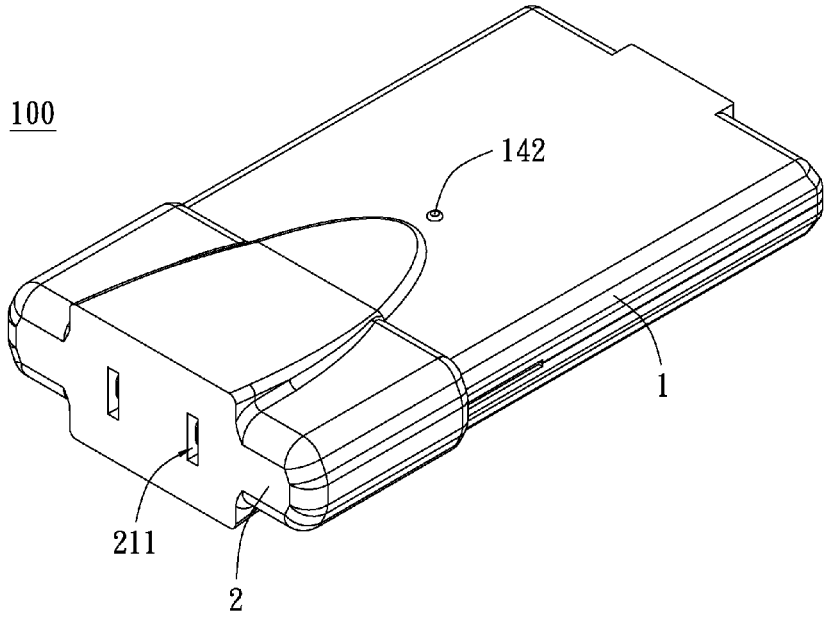
FIG. 5A is a perspective view of the current convertor of the first embodiment of the instant disclosure when the sliding cover is at a second position.

Please refer to FIG. 2, which shows a first embodiment of the instant disclosure. This embodiment provides a current convertor 100 for inserting into a conventional outlet 200 (e.g., wall outlet). The current convertor 100 has a current converting device 1 and a sliding cover 2. The sliding cover 2 is slidably disposed on the current converting device 1 for enabling the sliding cover 2 to slide between a first position (as FIG. 2A shown) and a second position (as FIG. 5A shown) along a sliding direction S relative to the current converting device 1.

The following description states the components of the current convertor 100 when the sliding cover 2 is at the first position.

Figure 2B:
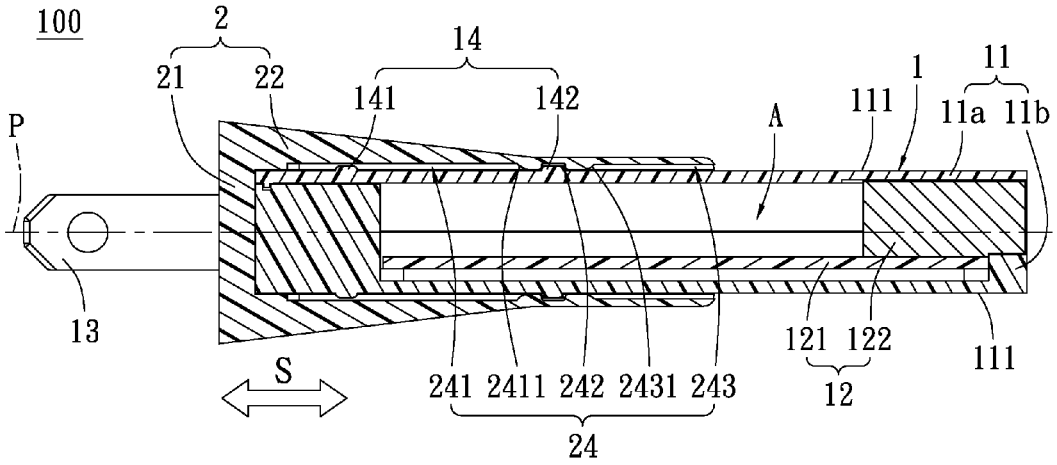
FIG. 2B is a section view of FIG. 2A.
Figure 3:
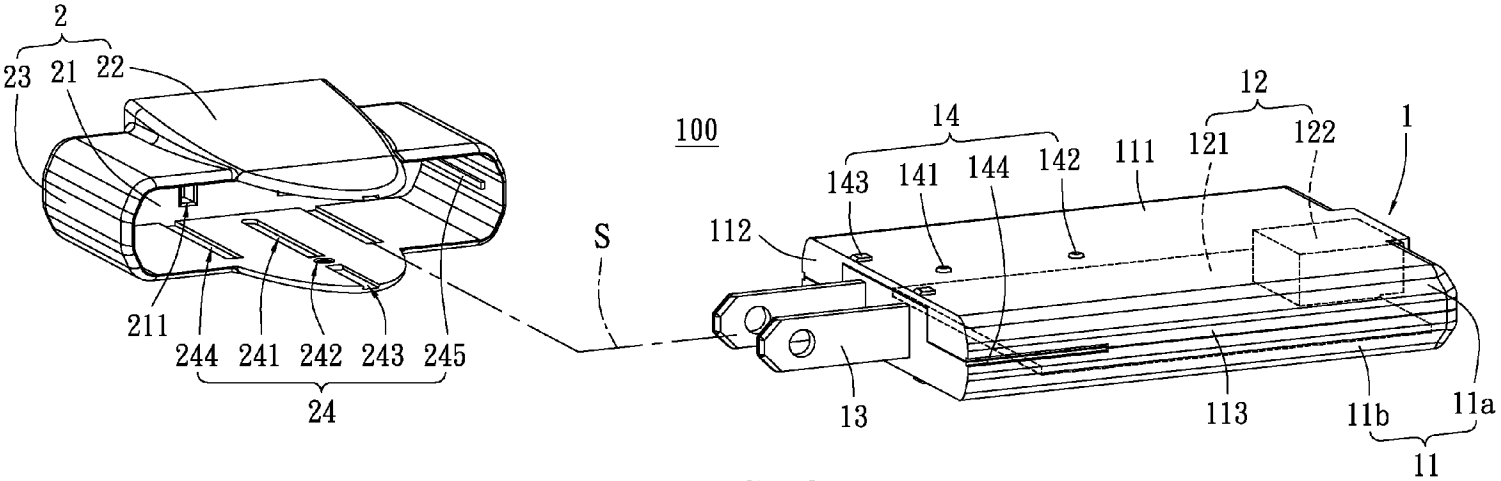
FIG. 3 an exploded view of the current convertor of the first embodiment of the instant disclosure.
Figure 4:
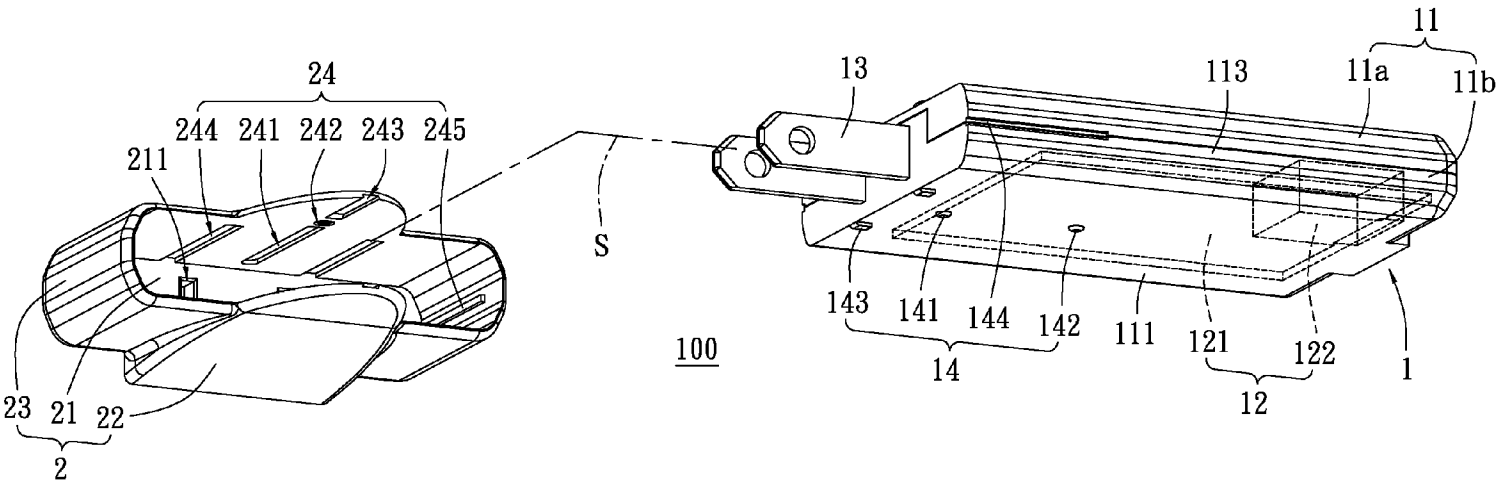
FIG. 4 an exploded view of the current convertor of the first embodiment of the instant disclosure at another viewing angle.

Please refer to FIGS. 2B, 3, and 4. The current converting device 1 has a casing 11, a current converting module 12, two conductive terminals 13, and a first sliding module 14. The casing 11 has a first shelter 11*a* and a second shelter 11*b* installed on the first shelter 11*a*.

The casing 11 has a cuboid shape, that is to say, an outer surface of the casing 11 has a pair of planes 111 parallel to each other, a pair of end surfaces 112, and a pair of lateral surfaces 113. Each plane 111 has a substantially rectangular shape. The end surfaces 112 and the lateral surfaces 113 are connected to have a rectangular ring shape and arranged between the edges of the planes 111. An inner surface of the casing 11 surroundingly defines an accommodating space A.

Moreover, the casing 11 defines a virtual bisection plane P arranged between the planes 111 and parallel to each plane 111.

The current converting module 12 is arranged in the accommodating space A of the casing 11. The current converting module 12 is used for transforming an AC input power to output a DC power. Specifically, the current converting module 12 has a circuit board 121 having a rectangular shape and a DC socket (e.g., USB socket). The DC socket 122 is provided for insertion of an electronic device, which is operated by DC power.

The current converting module 12 also has a plurality of electronic components disposed on the circuit board 121, and the electronic components is used for converting the AC input power to the DC power. The DC socket 122 is electrically connected to the circuit board 121. The DC socket 122 is clipped between the first shelter 11*a* and the second shelter 11*b*, and an inserting trough (not labeled in Figure) of the DC socket exposes from the end surface 112 of the casing 11.

The conductive terminals 13 are installed on the casing 11, and each conductive terminal 13 is partially embedded in the casing 11. The conductive terminals 13 are electrically connected to the current converting module 12 and partially exposed from the end surface 112 of the casing 11. Specifically, a direction parallel to the longitudinal direction of the exposed portion of each conductive terminal 13 is defined as the sliding direction S.

The first sliding module 14 is disposed on the first shelter 11*a* and the second shelter 11*b* of the casing 11. The first sliding module 14 has two first protrusions 141, two second protrusions 142, and four bumps 143.

The first sliding module 14 is approximately symmetrical to the virtual bisection plane P, so that the following description just states the components, which are disposed on the first shelter 11*a* (i.e., one of the first protrusions 141, one of the second protrusions 142, and two of the bumps 143).

The first protrusion 141 is approximately identical to the second protrusion 142. The first protrusion 141 and the second protrusion 142 are respectively protruded from the plane 111 of the first shelter 11*a* of the casing 11, and the first protrusion 141 is closer to the conductive terminals 13 than the second protrusion 142.

Moreover, a distance between the first protrusion 141 and the second protrusion 142 is parallel to the sliding direction S and approximately equal to a distance between the first position and the second position.

The bumps 143 are respectively protruded from one portion of the plane 111 of the first shelter 11*a*, which adjacent to the conductive terminals 13 and connected to the end surface 112.

Specifically, the bumps 143 are arranged on two opposite sides of a virtual straight line (e.g., the upper left side and the lower right side in FIG. 3), which passes through the first protrusion 141 and the second protrusion 142.

The sliding cover 2 has a base seat 21, two lateral plates 22, two extending plates 23, and a second sliding module 24. The base seat 21 has two thru holes 211, which are penetrating along the sliding direction S on the base seat 21. The sectional area of each thru hole 211, which is perpendicular to the sliding direction S, is approximately equal to (or slightly larger than) the sectional area of each conductive terminal 13, which is perpendicular to the sliding direction S.

The lateral plates 22 facing to each other and the extending plates 23 facing to each other are extending from the edge of the base seat 21 along the sliding direction S.

The second sliding module 24 has two first track troughs 241, two positioning troughs 242, two second track troughs 243, and four sliding troughs 244. The first track troughs 241, the positioning troughs 242, the second track troughs 243, and the sliding troughs 244 are formed on the lateral plates.

The second sliding module 24 is approximately symmetrical to the virtual bisection plane P, so that the following description just states the components, which are formed on the lateral plate 22 corresponding to the first shelter 11*a* (i.e., one of the first track troughs 241, one of positioning troughs 242, one of the second track troughs 243, and two of the sliding troughs 244).

The first track trough 241, the positioning trough 242, and the second track trough 243 are sequentially concavely formed on the inner surface of the lateral plate 22 along the sliding direction S. That is to say, the positioning trough 242 is formed between the first track trough 241 and the second track trough 243.

Specifically, the positioning trough 242 conforms in shape to each one of the first protrusion 141 and the second protrusion 142. Each one of the first track trough 241 and the second track trough 243 is presented strip-like and has a guiding surface 2411, 2431 adjacent to the positioning trough 242.

In other words, if something moving from the first track trough 241 to the second track trough 243 along the sliding direction S, it will sequentially contact the guiding surface 2411 of the first track trough 241, the positioning trough 242, and the guiding surface 2431 of the second track trough 243.

The sliding troughs 244 are arranged on two opposite sides of the first track trough 241 (i.e., the left side and the right side in FIG. 3), and the sliding troughs 244 are respectively concavely formed from one end portion of the inner surface of the lateral plate 22, which is connected to the base seat 21, along the sliding direction S.

Figure 5B:
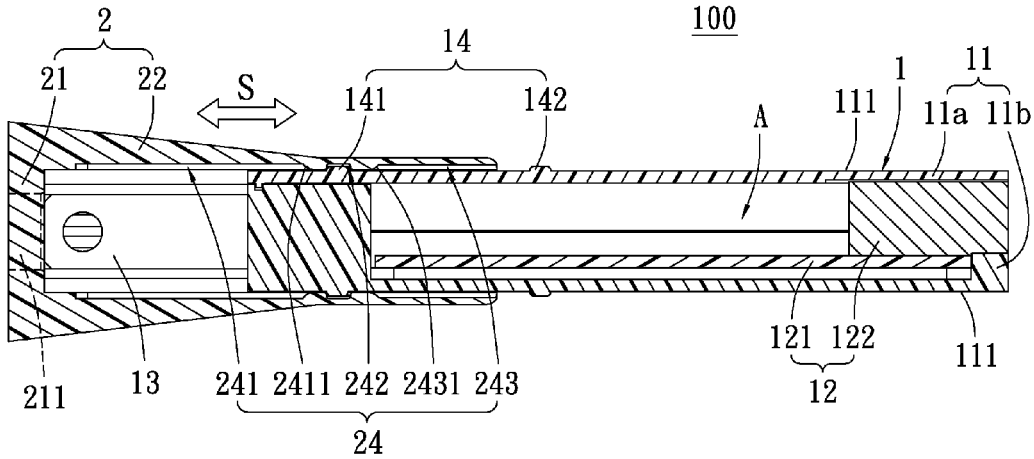
FIG. 5B is a section view of FIG. 5A.

Please refer to FIGS. 2B, 3, and 5B. When the sliding cover 2 is installed on the current converting device 1, the sliding cover 2 covers at least partial the outer surface of the casing 11, and the second sliding module 24 is slidably disposed on the first sliding module 14 for enabling the sliding cover 2 to slide between the first position and the second position along the sliding direction S relative to the casing 11.

The distance between the first position and the second position is approximately equal to the length of the exposed portion of each conductive terminal 13, which is exposed from the casing 11.

When the sliding cover 2 is sliding between the first position and the second position, the first protrusion 141 is arranged in and relatively slidable with respect to the first track trough 241, and the second protrusion 142 is arranged in and relatively slidable with respect to the second trough 243. Moreover, the bumps 143 are respectively arranged in and relatively slidable with respect to the sliding troughs 244.

When the sliding cover 2 is at the first position, the first protrusion 141 is arranged in the first track trough 241, and the second protrusion 142 is wedged in the positioning trough 242 via the guiding surface 2431 for maintaining the sliding cover 2 at the first position. The bumps 143 are respectively arranged in the sliding troughs 244 and adjacent to the base seat 21 of the sliding cover 2.

Moreover, the sliding cover 2 covers partial the outer surface of the casing 11 (e.g., the end surface 112 provided the conductive terminals 13 passing therethrough, part of the planes 111, and part of the lateral surfaces 113), and the conductive terminals 13 pass through the thru holes 211 of the sliding cover 2 for inserting into the conventional outlet 200.

Specifically, the ratio, which is the outer surface of the casing 11 covering by the sliding cover 2, is about 25% to 50%. That is to say, the sliding cover 2 covers fourth to half of the outer surface of the casing 11. The ratio is 33% in this embodiment, but is not limited thereto.

Thus, the accommodating space A of the casing 11 can be applied more effective for reducing the size of the casing 11 in achievement of user's demand (e.g., miniaturization of the current convertor 100).

When the sliding cover 2 is at the second position, the second protrusion 142 is arranged in the second track trough 243, and the first protrusion 141 is wedged in the positioning trough 242 via the guiding surface 2411 for maintaining the sliding cover 1 at the second position. The bumps 143 are respectively arranged in the sliding troughs 244 and away from the base seat 21 of the sliding cover 2.

Thus, the conductive terminals 13 are arranged in a space surrounded by the sliding cover 2 and casing 11 for protecting the conductive terminals 13 by the sliding cover 2, and the bumps 143 are arranged in the sliding troughs 244 to prevent the sliding cover 2 from detaching the casing 11.

Incidentally, the first sliding module 14 can further has two grooves 144 respectively concavely formed on the lateral surfaces 113 along the sliding direction S. The second sliding module 24 further has two sliding blocks 245 respectively formed on the extending plates 23 of the sliding cover 2. Each sliding block 245 conforms in shape to each groove 144, and each sliding block 245 is slidably arranged in each groove 144.

Second Embodiment

Figure 6A:
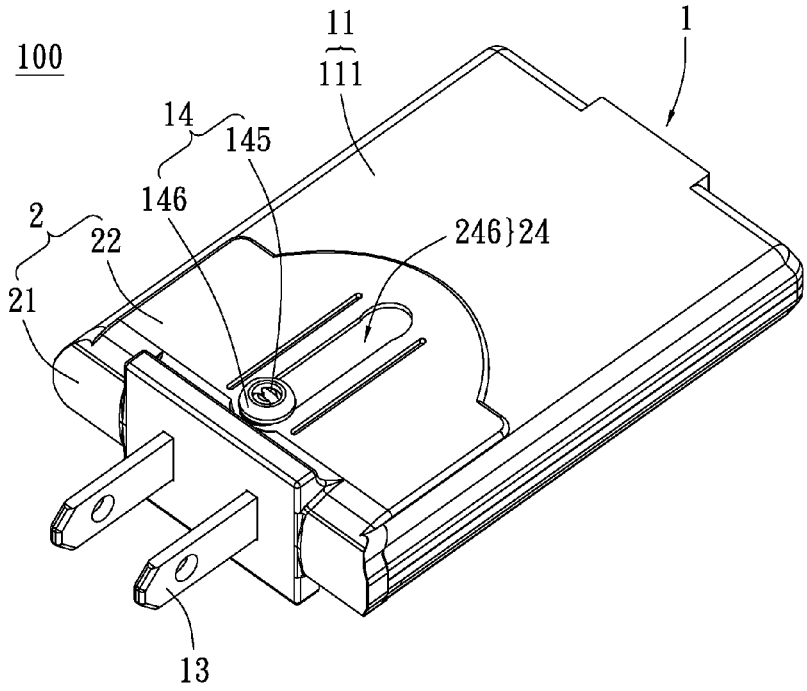
FIG. 6A is a perspective view of the current convertor of a second embodiment of the instant disclosure when the sliding cover is at the first position.
Figure 6B:
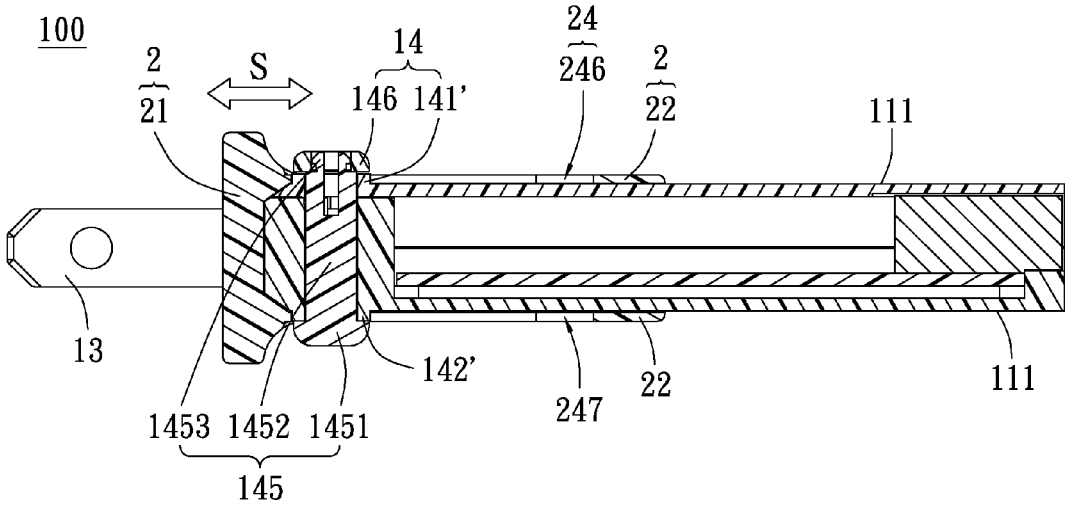
FIG. 6B is a section view of FIG. 6A.

Please refer to FIGS. 6A and 6B, which show a second embodiment of the instant disclosure. The second embodiment is similar to the first embodiment, and the difference between both is the first sliding module 14 and the sliding cover 2.

Figure 7:
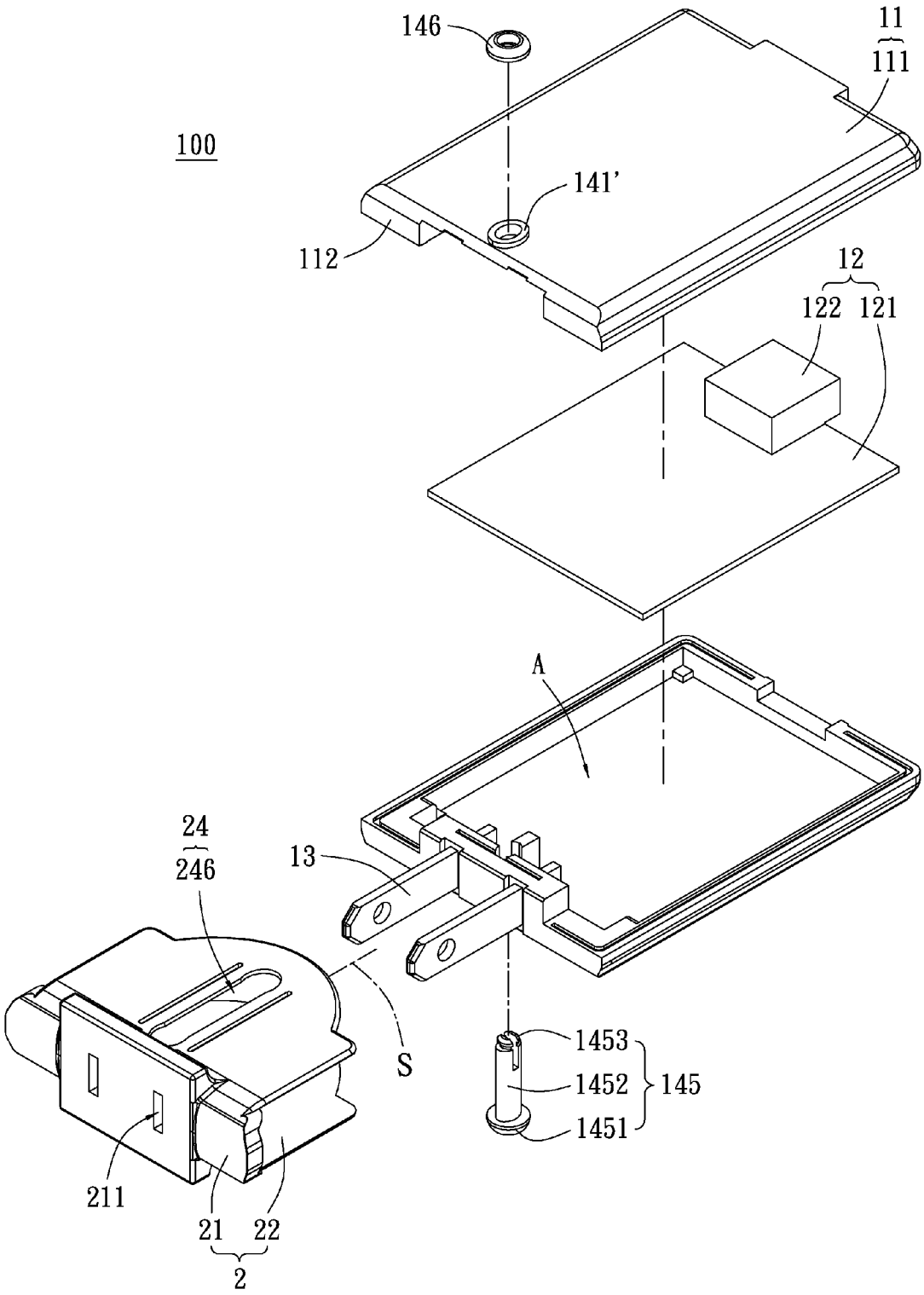
FIG. 7 an exploded view of the current convertor of the second embodiment of the instant disclosure.

Please further refer to FIG. 7. The first sliding module 14 has a first protrusion 141', a second protrusion 142', a positioning piece 145, and a buckling ring 146. The first protrusion 141' and the second protrusion 142' are respectively protruded from two opposite outer surfaces of the casing 11 (e.g., planes 111).

Each one of the first protrusion 141' and the second protrusion 142' has a hollow shape. The first protrusion 141' and the second protrusion 142' are disposed on the portions of the planes 111 adjacent to the conductive terminals 13. The positioning piece 145, which in this embodiment takes a bolt for example, has a head portion 1451, an extending portion 1452, and a wedged portion 1453. Two ends of the extending portion 1452 respectively connect to the head portion 1451 and the wedged portion 1453.

The sliding cover 2 has a base seat 21 having two thru holes 211, two side plates 22 respectively extended from two opposite ends of the base seat 21 along the sliding direction S, and a second sliding module 24.

The second sliding module 24 has a first track hole 246 and a second track hole 247, which are respectively formed on the side plates 22 along the sliding direction S.

Figure 8:
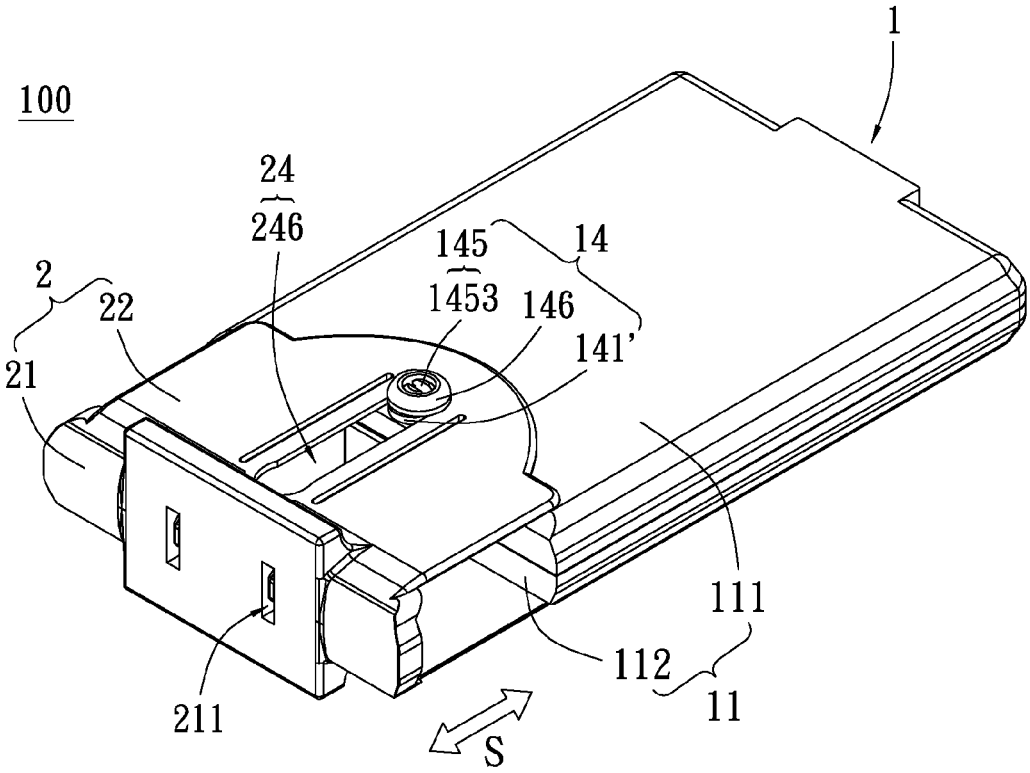
FIG. 8 is a perspective view of the current convertor of the second embodiment of the instant disclosure when the sliding cover is at the second position.

The sliding cover 2 is installed on the current converting device 1, and the sliding cover 2 covers at least partial the outer surface of the casing 11. Moreover, the sliding cover 2 is configured to slide between a first position (as FIG. 6A shown) and a second position (as FIG. 8 shown) along the sliding direction S relative to the current converting device 1 by the second sliding module 24 engaged with the first sliding module 14.

The first protrusion 141' and the second protrusion 142' are respectively arranged in and relatively slidable with respect to the first track hole 246 and the second track hole 247. Moreover, the positioning piece 145 passes through the first protrusion 141', the casing 11, and the second protrusion 142', and the buckling ring 146 is engaged with one portion of the positioning piece 145, which is passing through the second protrusion 142'. The outer surfaces of the lateral plates 22 are clipped by the positioning piece 145 and the buckling ring 146, and the longitudinal direction of the positioning piece 145 is approximately perpendicular to the planes 111 of the casing 11, so that the sliding cover 2 is slidably disposed on the casing 11 more firm.

Specifically, the head portion 1451 abuts on one portion of the outer surface of one of the side plates 22, which is adjacent to the first track hole 246. The extending portion 1452 passes through the first protrusion 141', the casing 11, and the second protrusion 142'. The wedged portion 1453 is engaged with the buckling ring 146 and abuts on one portion of the outer surface of another side plate 22 adjacent to the second track hole 247.

However, the sectional area of the head portion 1451 of the positioning piece 145 can be increased to add the contact area between the head portion 1451 and the lateral plate 22 according to the designer's demand for improving the fixing effect between the sliding cover 2 and the casing 11. Moreover, the extending portion 1452 of the positioning piece 145 has an approximately elliptic shape for prevent the positioning piece 145 from spinning along the longitudinal direction thereof.

The distance between the first position and the second position is approximately equal to the length of the exposed portion of each conductive terminal 13, which is exposed from the casing 11.

Specifically, when the sliding cover 2 is at the first position (as FIG. 6B shown), the first protrusion 141' and the second protrusion 142' are respectively arranged in one side of the first track hole 246 and the second track hole 247 (e.g., the left side of the first track hole 246 and the second track hole 247). The sliding cover 2 covers partial the outer surface of the casing 11 (e.g., the end surface 112 provided the conductive terminals 13 passing therethrough and part of the planes 111), and the conductive terminals 13 pass through the thru holes 211 of the sliding cover 2 for inserting into the conventional outlet 200.

Specifically, the ratio, which is the outer surface of the casing 11 covering by the sliding cover 2, is about 25% to 50%. That is to say, the sliding cover 2 covers fourth to half of the outer surface of the casing 11. The ratio is 33% in this embodiment, but is not limited thereto.

Thus, the accommodating space A of the casing 11 can be applied more effective for reducing the size of the casing 11 in achievement of user's demand (e.g., miniaturization of the current convertor 100).

When the sliding cover 2 is at the second position (as FIG. 8 shown), the first protrusion 141' and the second protrusion 142' are respectively arranged in the opposite side of the first track hole 246 and the second track hole 247 (e.g., the right side of the first track hole 246 and the second track hole 247). Thus, the conductive terminals 13 are arranged in a space surrounded by the sliding cover 2 and casing 11 for protecting the conductive terminals 13 by the sliding cover 2.

Incidentally, each lateral plate 22 has two elongated holes (not labeled) parallel to the sliding direction S and respectively arranged on two opposite sides of the first track hole 246 (e.g., the upper left side and the lower right side in FIG. 6A), so that two portions arranged between the elongated holes and the first track hole 246 are regarded as two elastic arms.

Thus, when the sliding cover 2 is sliding between the first position and the second position, the elastic arms are deformed outwardly by the pressing of the first protrusion 141'. When the sliding cover 2 is at the first position or the second position, the elastic arms are reinstated.

Besides, the positioning piece 145 in this embodiment takes the bolt for example, but in use, the positioning piece 145 can be a rivet, a cotter, a spring pin, a R-shoot, a nail, or the other fixed component.

Third Embodiment

Figure 9A:
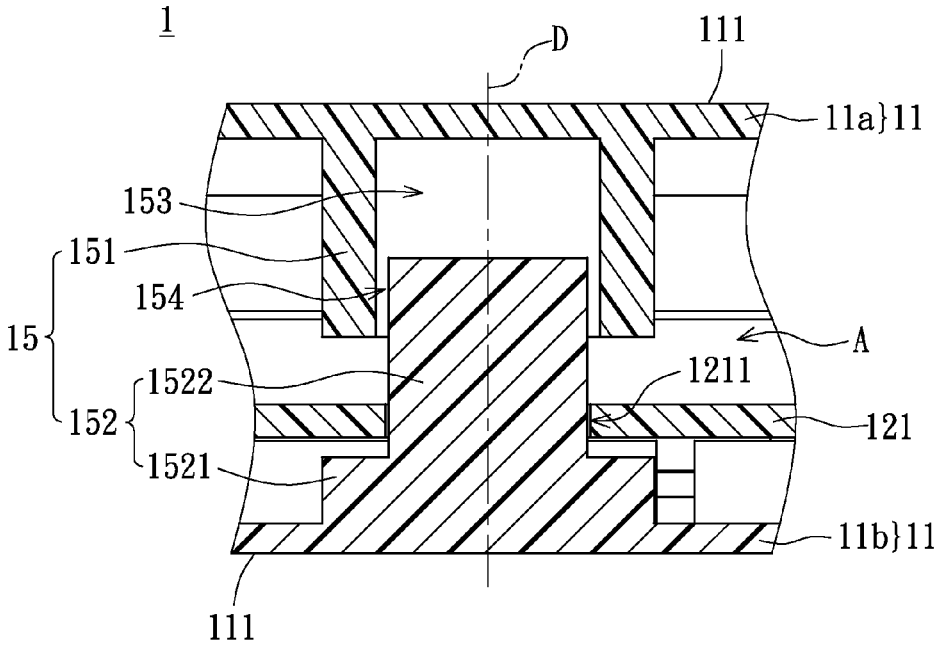
FIG. 9A is a section view of the current convertor of a third embodiment of the instant disclosure.
Figure 9B:
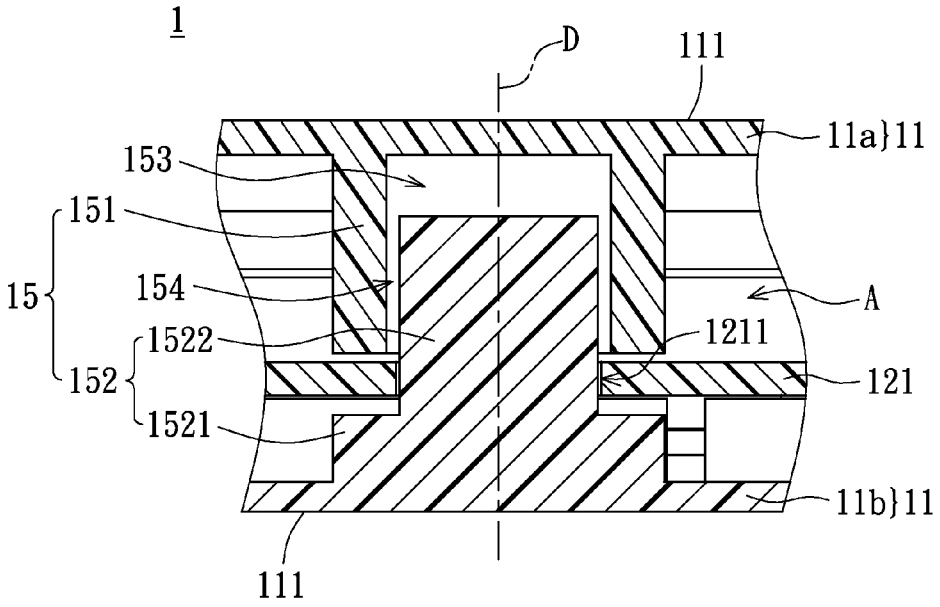
FIG. 9B is a section view of the current convertor of the third embodiment of the instant disclosure when pressing a casing.

Please refer to FIGS. 9A and 9B, which show a third embodiment of the instant disclosure. The third embodiment is similar to the above embodiments, and the difference between the third embodiment and the above embodiments is that the third embodiment further has a buffer structure 15.

The casing 11 defines a thickness direction D, and the second shelter 11*b* is installed on the first shelter 11*a* approximately along the thickness direction D.

The buffer structure 15 has a first buffer portion 151 disposed on the inner surface of the casing 11 and a second buffer portion 152 disposed on the inner surface of the casing 11 and facing the first buffer portion 151.

The first buffer portion 151 and the second buffer portion 152 are respectively extended toward each other from the inner surface of the first shelter 11*a* and the inner surface of the second shelter 11*b* along the thickness direction D, and shall not be limited to the example of the instant embodiment. The inner surfaces of the casing 11 are arranged on opposite side of the planes 111.

For example, the first buffer portion 151 and the second buffer portion 152 can be formed on the inner surface of the first shelter 11*a* and the inner surface of the second shelter 11*b* by another means (e.g., engaging, adhering, or screwing).

Specifically, the first buffer portion 151 has a tubular shape, and the second buffer portion 152 has a cylinder shape. The second buffer portion 152 has a large diameter segment 1521 extended from the inner surface of the second shelter 11*b* and a small diameter segment 1522 extended from the large diameter segment 1521. The diameter of the small diameter segment 1522 is smaller than the diameter of the large diameter segment 1521.

Moreover, the structure of the first buffer portion 151 and the structure of the second buffer portion 152 can be changed as they are matching with each other, and shall not be limited to the above example of the instant embodiment.

The small diameter segment 1522 passes through a thru hole 1211 formed on the circuit board 121 and inserts into the first buffer portion 151 along the thickness direction D. Moreover, an end surface of the first buffer portion 151 and an end surface of the large diameter segment 1521 are respectively spaced arranged with the opposite surfaces of the circuit board 121. A gap arranged between the end surface of the first buffer portion 151 and the surface of the circuit board 121 is defined as a buffer distance, and a gap arranged between the end surface of the large diameter segment 1521 and the opposite surface of the circuit board 121 is also defined as a buffer distance.

Moreover, a space is leaving between an end surface of the small diameter segment 1522 and the inner surface of the first shelter 11*a*. The inner diameter of the first buffer portion 151 is slightly larger than the diameter of the small diameter segment 1522. In other words, the first buffer portion 151 and the small diameter segment 1522 of the second buffer portion 152 surroundingly define a buffer space 153 and a gap 154 in communication with the buffer space 153. Specifically, the buffer space 153 is communicated to the outer space arranged outside the buffer structure 15 just via the gap 154.

The gap 154 scale in the figure is used to explain, and the gap 154 scale can be changed by the designer. For example, the gap 154 can be designed to gradually reduce along one direction, which from the first shelter 11*a* to the second shelter 11*b*.

Thus, when pressing the casing 11 along the thickness direction D (as FIG. 9B shown), the buffer distances are provided for enabling the first shelter 11*a* and the second shelter 11*b* to move toward each other, and the air in the buffer space 153 flows out via the gap 154 for reducing the relative speed between the first buffer portion 151 and the second buffer portion 152, thereby reducing the broken possibility of the current converting device 1.

Base on the above, the space surrounded by the casing of the current convertor in the instant disclosure is applied effectively by setting the sliding cover without any wasted space.

Moreover, when the sliding cover is at the first position, the conductive terminals are configured to insert into the conventional outlet, and the volume of the current convertor of the instant disclosure is smaller than the conventional current convertor. When the sliding cover is at the second position, the sliding cover is configured to protect the conductive terminals.

Additionally, when pressing the casing along the thickness direction, the relative speed of the first shelter and the second shelter is reduced by a gas-valve structure, that is the first buffer portion and the second buffer portion, thereby reducing the broken possibility of the current converting device.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims

What is claimed is:

1. A current convertor for inserting into a conventional outlet, comprising:

a current converting device comprising:

a casing, which surroundingly defines an accommodating space;

a current converting module arranged in the accommodating space of the casing;

two conductive terminals electrically connected to the current converting module and partially exposed from the casing, wherein a direction parallel to the longitudinal direction of each conductive terminal is defined as a sliding direction; and a first sliding module disposed on the casing, wherein the first sliding module has a first and a second protrusions respectively protruded from the outer surface of the casing, and the first protrusion is closer to the thru holes of the casing than the second protrusion; and a sliding cover having a second sliding module, wherein the second sliding module is slidably arranged with the first sliding module for enabling the sliding cover to slide between a first position and a second position along the sliding direction relative to the casing, wherein the sliding cover has two thru holes, when the sliding cover is at the first position, the sliding cover covers at least partial an outer surface of the casing, and the conductive terminals pass through the thru holes of the sliding cover for inserting into the conventional outlet, and wherein when the sliding cover is at the second position, the conductive terminals are arranged in a space surrounded by the sliding cover and the casing, wherein the second sliding module has a first and a second track troughs sequentially extended along the sliding direction, and wherein when the sliding cover sliding between the first and the second positions, the first protrusion is arranged in and relatively slidable with respect to the first track trough, and the second track protrusion is arranged in and relatively slidable with respect to the second trough.

2. The current convertor as claimed in claim 1, wherein the second sliding module has a positioning trough formed between the first and the second track troughs, wherein when the sliding cover is at the first position, the second protrusion is wedged with the positioning trough for maintaining the sliding cover at the first position, and wherein when the sliding cover is at the second position, the first protrusion is wedged with the positioning trough for maintaining the sliding cover at the second position.

3. The current convertor as claimed in claim 2, wherein a distance between the first protrusion and the second protrusion is approximately equal to a distance between the first position and the second position.

4. The current convertor as claimed in claim 2, wherein the first sliding module has a bump protruded from the outer surface of the casing, and wherein the second sliding module has a sliding trough extended along the sliding direction, and the bump is arranged in and relatively slidable with respect to the sliding trough.

5. The current convertor as claimed in claim 1, wherein when the sliding cover is at the first position, the sliding cover covers fourth to half of the outer surface of the casing.

6. The current convertor as claimed in claim 1, wherein the distance of one portion of each conductive terminal exposed from the casing is approximately equal to a distance between the first position and the second position.

7. A current convertor for inserting into a conventional outlet, comprising:

a current converting device comprising:

a casing, which surroundingly defines an accommodating space;

a current converting module arranged in the accommodating space of the casing;

two conductive terminals electrically connected to the current converting module and partially exposed from the casing, wherein a direction parallel to the longitudinal direction of each conductive terminal is defined as a sliding direction; and a first sliding module disposed on the casing, wherein the first sliding module has a first and a second protrusions respectively protruded from two opposite outer surfaces of the casing; and a sliding cover having a second sliding module, wherein the second sliding module is slidably arranged with the first sliding module for enabling the sliding cover to slide between a first position and a second position along the sliding direction relative to the casing, wherein the sliding cover has two thru holes, when the sliding cover is at the first position, the sliding cover covers at least partial an outer surface of the casing, and the conductive terminals pass through the thru holes of the sliding cover for inserting into the conventional outlet, and wherein when the sliding cover is at the second position, the conductive terminals are arranged in a space surrounded by the sliding cover and the casing, wherein the sliding cover has a base seat having the thru holes and two side plates respectively extended from two opposite ends of the base seat along the sliding direction, the second sliding module has a first and a second track holes respectively formed on the side plates along the sliding direction, and wherein the first second protrusion and the second protrusion are respectively arranged in and relatively slidable with respect to the first track hole and the second track hole.

8. The current convertor as claimed in claim 7, wherein each one of the first protrusion and the second protrusion has a hollow shape, the first sliding module has a positioning piece and a buckling ring, and wherein the positioning piece passes through the first protrusion, the casing, and the second protrusion, and the buckling ring is engaged with one portion of the positioning piece passing through the second protrusion.

9. The current convertor as claimed in claim 8, wherein the positioning piece has a head portion, an extending portion, and a wedged portion, and the extending portion connects to the head portion and the wedged portion, and wherein the head portion abuts on one portion of an outer surface of one of the side plates adjacent to the first track hole, the extending portion passes through the first protrusion, the casing, and the second protrusion, and the wedged portion is engaged with the buckling ring and abuts on one portion of an outer surface of another side plate adjacent to the second track hole.

* * * * *